United States Patent [19]

Bichi

[11] 4,275,555

[45] Jun. 30, 1981

[54] MACHINE AND A METHOD FOR CONSTRUCTING A CHAIN HAVING AUTOMATICALLY SHAPED AND WELDED CHAIN LINKS

[75] Inventor: Pasquale Bichi, Arezzo, Italy

[73] Assignee: Gori & Zucchi S.p.A., Italy

[21] Appl. No.: 41,530

[22] Filed: May 22, 1979

Related U.S. Application Data

[63] Continuation-in-part of Ser. No. 822,800, Aug. 8, 1977, abandoned.

[30] Foreign Application Priority Data

Aug. 20, 1976 [IT] Italy ..... 50977 A/76

[51] Int. Cl.[3] ..... B21L 3/02

[52] U.S. Cl. ..... 59/3; 59/17; 59/18; 59/22; 59/23; 59/31; 59/35 R

[58] Field of Search ..... 59/1, 3, 16, 17, 20, 59/22, 23, 25, 26, 31, 33, 34, 35, 18; 219/51, 52

[56] References Cited

U.S. PATENT DOCUMENTS

| | | | |
|---|---|---|---|
| 310,317 | 1/1885 | Reinisch | 59/16 |
| 943,110 | 12/1909 | Fessler | 59/17 |
| 1,866,837 | 7/1932 | Brown | 59/35 |
| 2,065,788 | 12/1936 | Biedermann | 59/16 |
| 2,617,250 | 11/1952 | Kunzmann et al. | 59/17 |

FOREIGN PATENT DOCUMENTS

| | | | |
|---|---|---|---|
| 944304 | 5/1956 | Fed. Rep. of Germany | 59/17 |
| 460241 | 11/1913 | France | 59/31 |

*Primary Examiner*—John McQuade
*Attorney, Agent, or Firm*—Holman & Stern

[57] ABSTRACT

A machine for constructing a chain of metallic shaped links from a continuous wire including:

means for shaping the wire in the form of a cylindrical wire spiral; means for gripping the first free turn of the spiral; means for cutting away the first spiral turn and associated with shaping means to urge the ends of the first turn to approach to one another, to form a chain link; shaping means to impart the desired configuration to the chain link; welding means to weld the ends of the chain link; and control means to move into the operative or inoperative positions and to make operative or inoperative in a predetermined time sequence and at desired times the various means composing the machine.

8 Claims, 25 Drawing Figures

FIG. 5B(1)
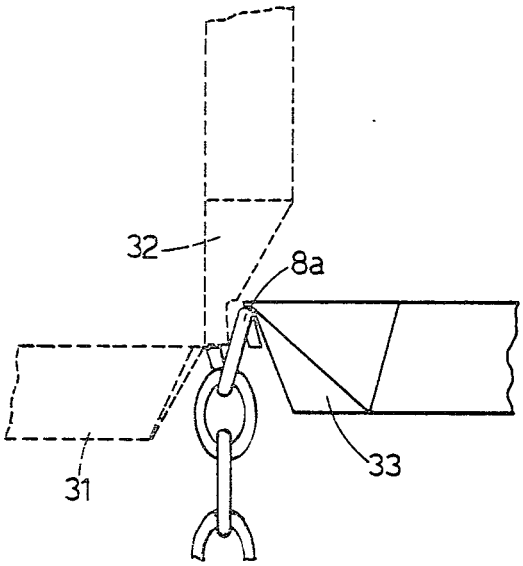
FIG. 5B(2)
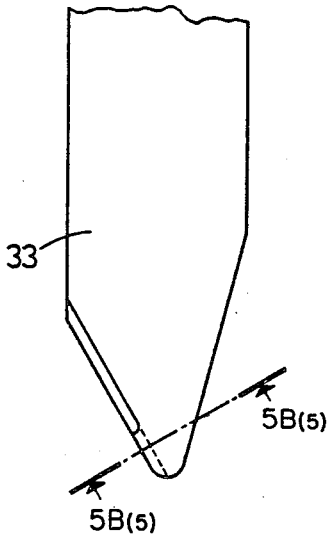
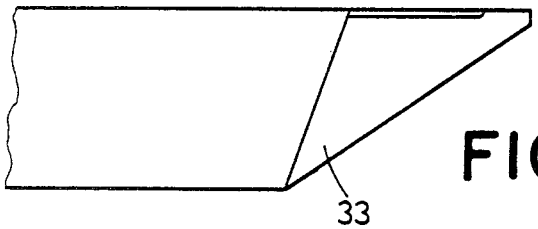
FIG. 5B(4)
FIG. 5B(3)
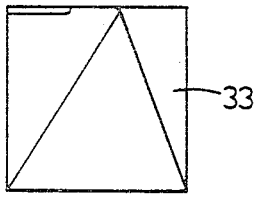
FIG. 5B(5)
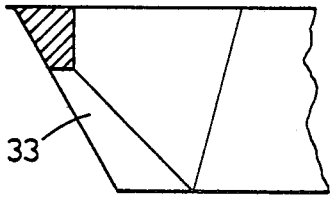

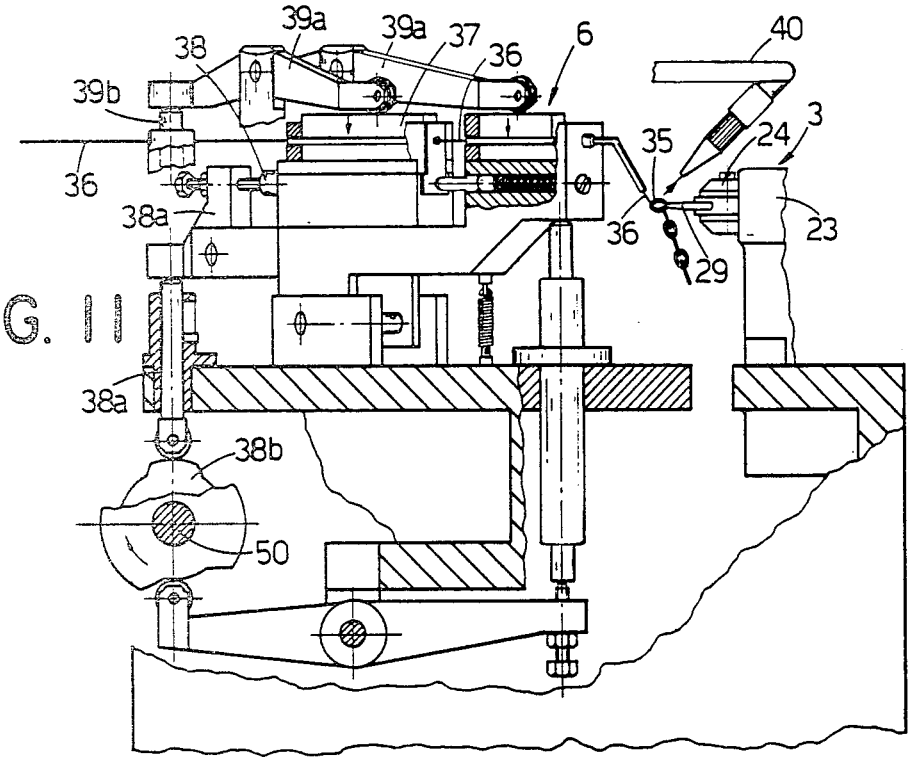
FIG. 11
FIG. 12
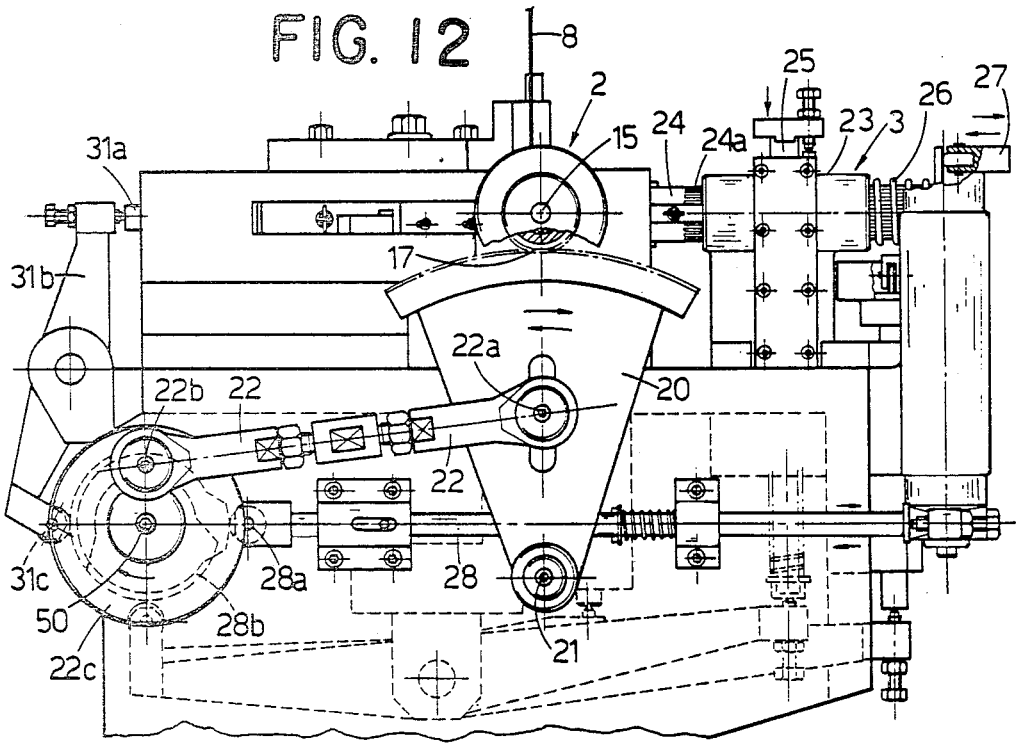

MACHINE AND A METHOD FOR CONSTRUCTING A CHAIN HAVING AUTOMATICALLY SHAPED AND WELDED CHAIN LINKS

This is a continuation-in-part of application Ser. No. 822,800, filed Aug. 8, 1977, now abandoned.

The present invention relates to a machine and to a method for constructing a chain having metallic chain links of an annular configuration, each of said chain links being automatically shaped, then inserted in the preceding already obtained chain link and welded on both the ends of the wire section which has been utilized to construct said chain link.

The machine comprises:

a feed spool for feeding the wire designed to form the chain links;

a device adapted to wind said wire according to the shape of a cylindrical spiral of predetermined radius and pitch or other similar shape;

a device carrying pliers and associated with means for moving to and from the pliers members so as to carry these latter to grip and hold the first wire turn of said spiral on its outer side and which carries the last obtained chain link;

a reciprocating cutting device for cutting the first turn of the spiral off from the remaining part of said wire spiral;

a shaping device for transforming each separated wire turn into an annular piece of the desired shape and having contacting ends;

a welding means to solder or weld by means of an autogenous welding method, i.e., without any weld material, the link end portions one to the other so as to produce a shaped and closed chain link, which the pliers supporting device causes to be passed though the end of the now first spiral turn; and means to control the movements of the devices and means forming the machine into the operative position and their return in their inoperative position as well as their operation at predetermined times and during predetermined time intervals. The machine of the invention thus enables one to automatize all the steps necessary for the construction of a chain with welded shaped chain links, which operation has hitherto always required the intervention of an operator, in particular, for performing the welding of the chain links.

Therefore, this machine enables one to attain a high production per hour as well as to produce perfectly identical chain links. These and other characteristics of the invention will be better understood from the following description of an embodiment of the invention, taken in consideration together with the accompanying drawings, in which.

Figure 2:
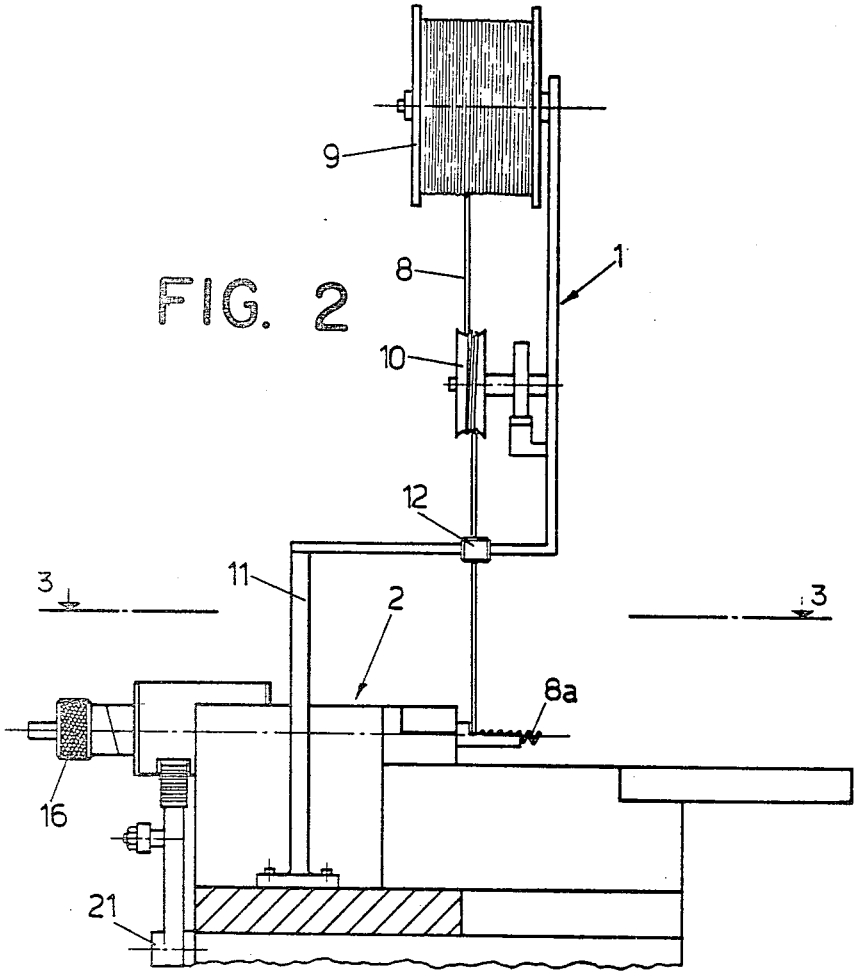
FIG. 2 shows a side view of the detail of the feed spool of the wire which is designed to form the chain links, and of the unit where the wire spiral is formed, said view being taken along line 2—2 of FIG. 3.
Figure 3:
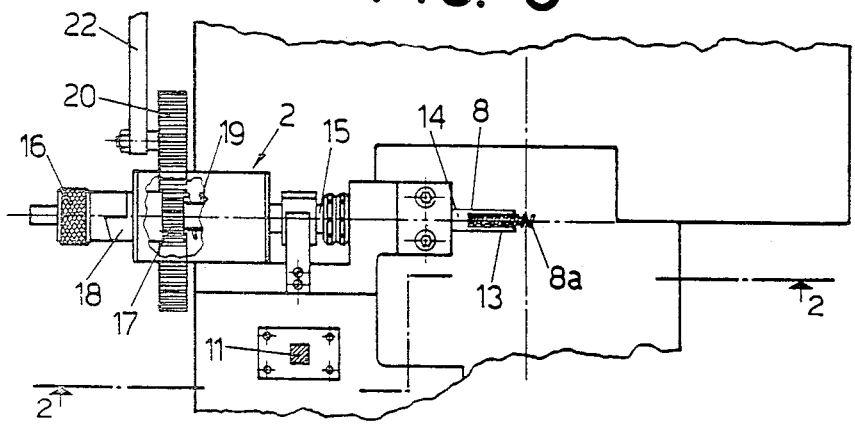
Figure 2A:
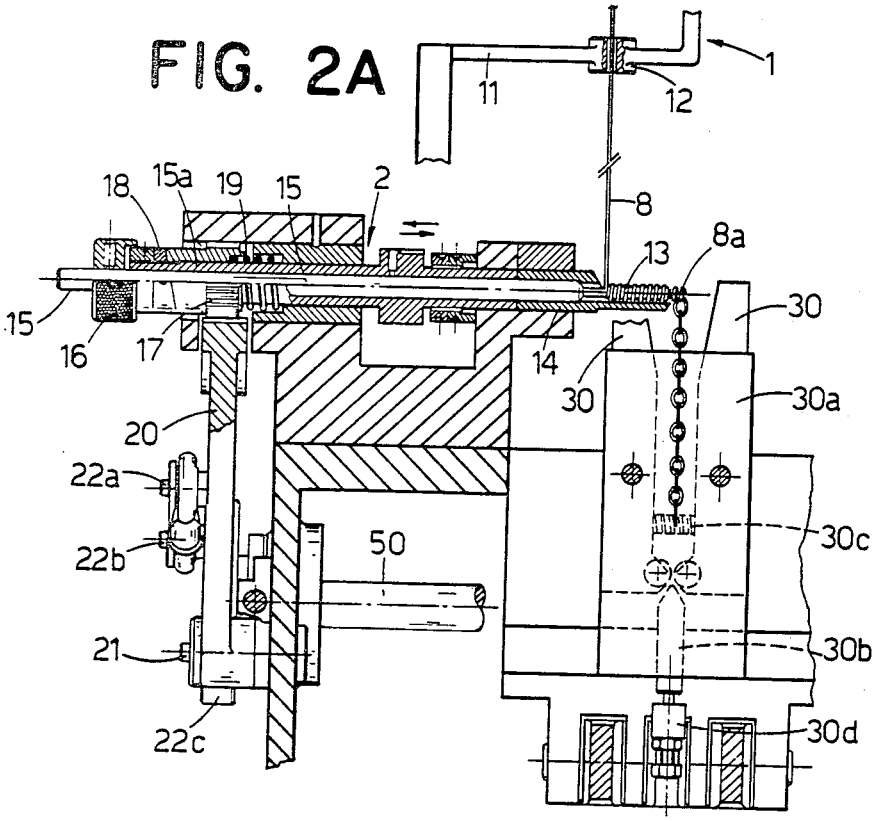
Figure 5A:
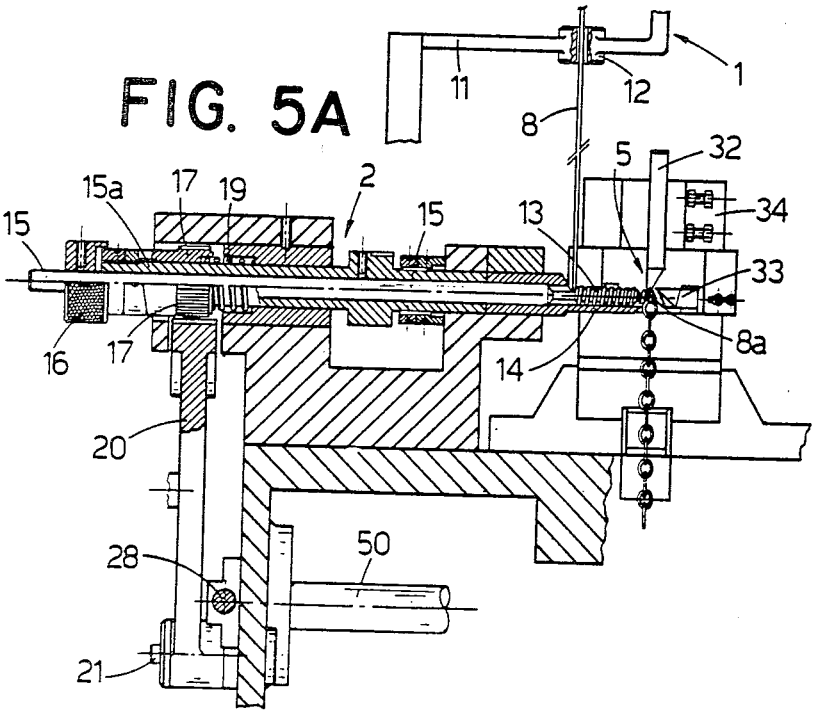
Figure 4:
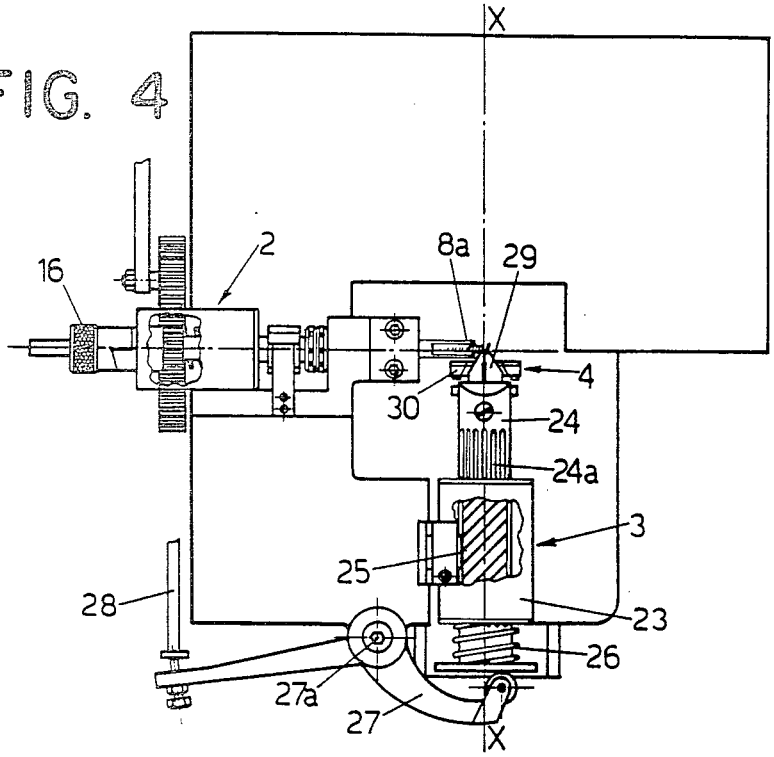
Figure 5:
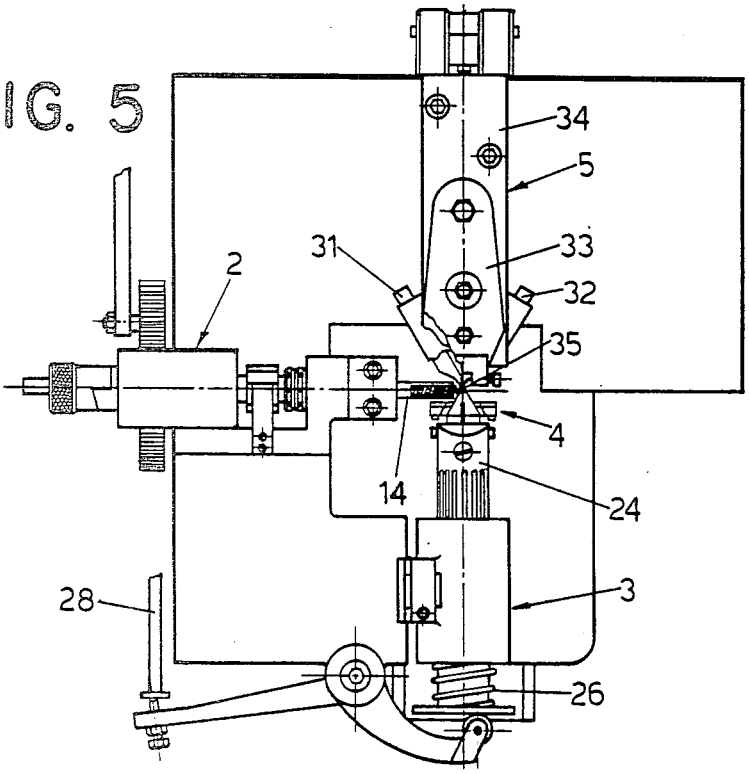
Figure 5B:
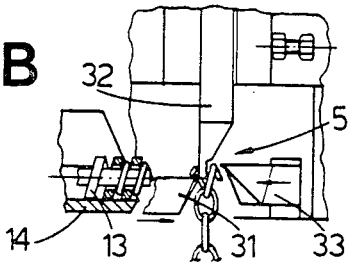

FIG. 2*a* is a vertical section taken on line 2*a*—2*a* of FIG. 3;

FIG. 3 is a top view of the devices of FIG. 2 taken from the plane 3—3 of FIG. 2;

FIG. 4 is a top view of the unit for shaping the wire spiral and of the pliers supporting device;

FIG. 5 is a top view of the two devices shown in FIG. 4 as well as of the unit for the cutting of one wire turn;

FIG. 5*a* is the vertical section 2*a*—2*a* of FIG. 3, during the cutting step;

FIG. 5*b* is a detail in enlarged scale of FIG. 5*a;*

Figure 6A:
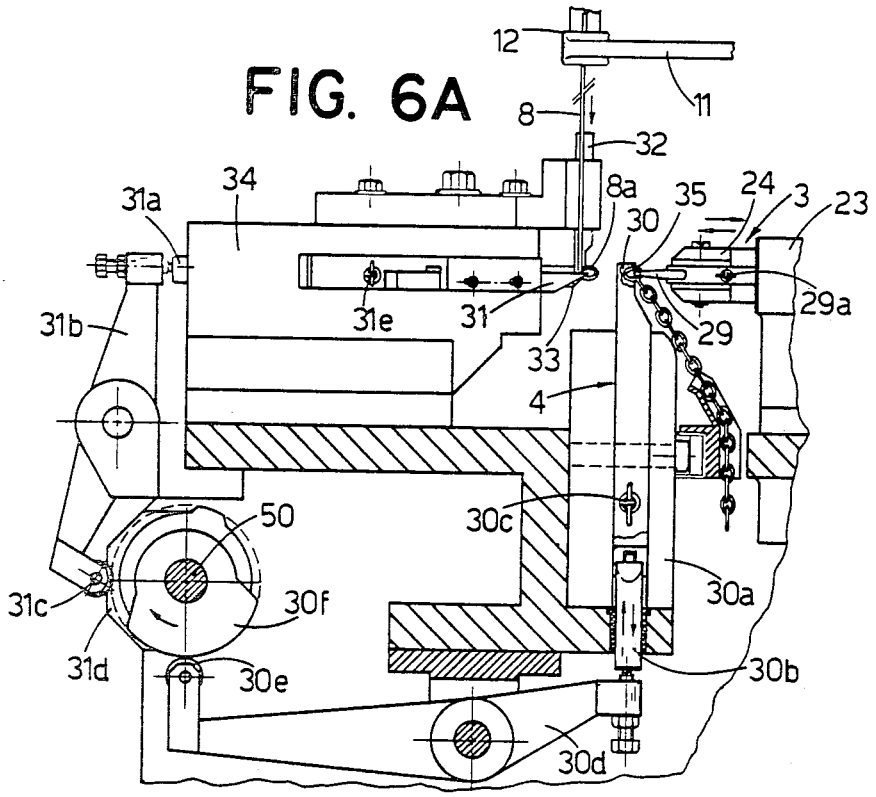
Figure 6B:
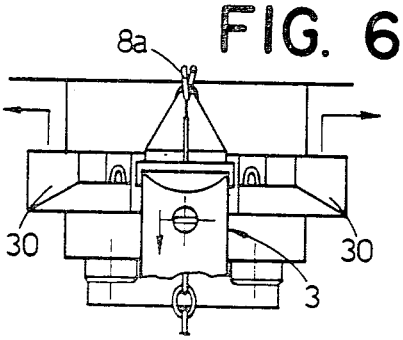
Figure 6C:
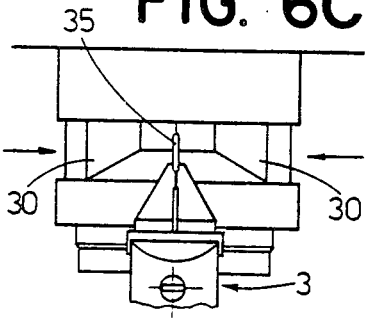
Figure 6:
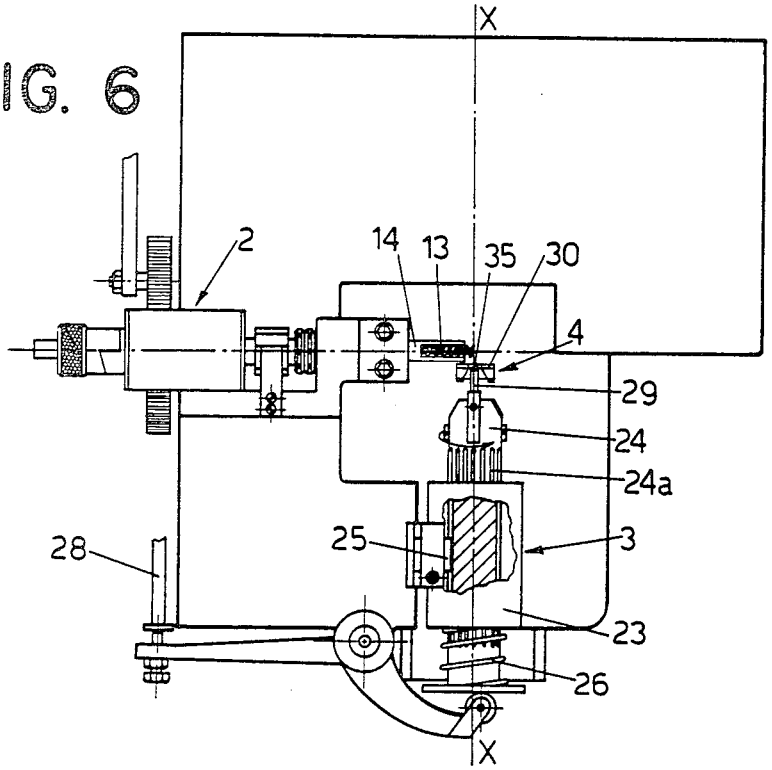
Figure 8:
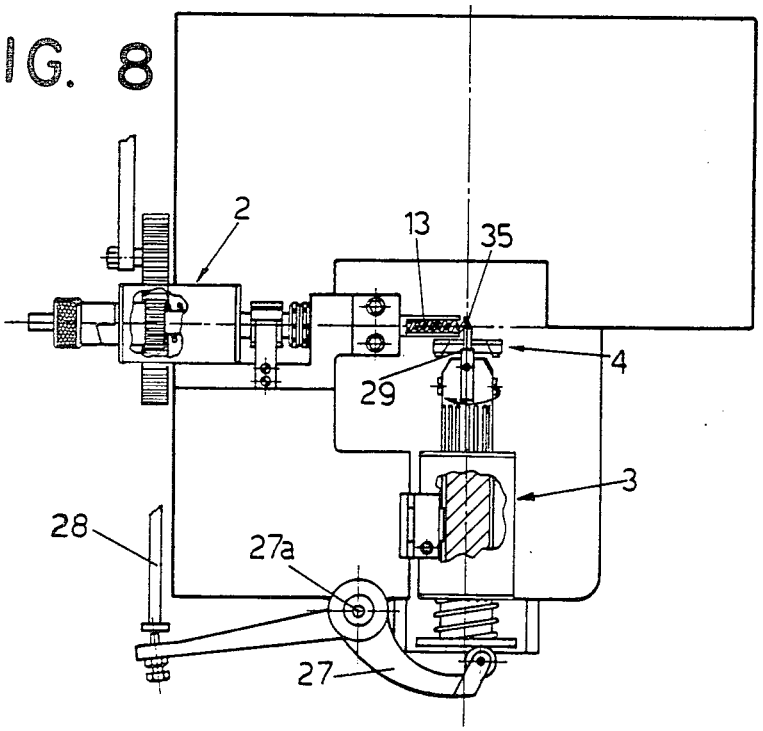
Figure 7:
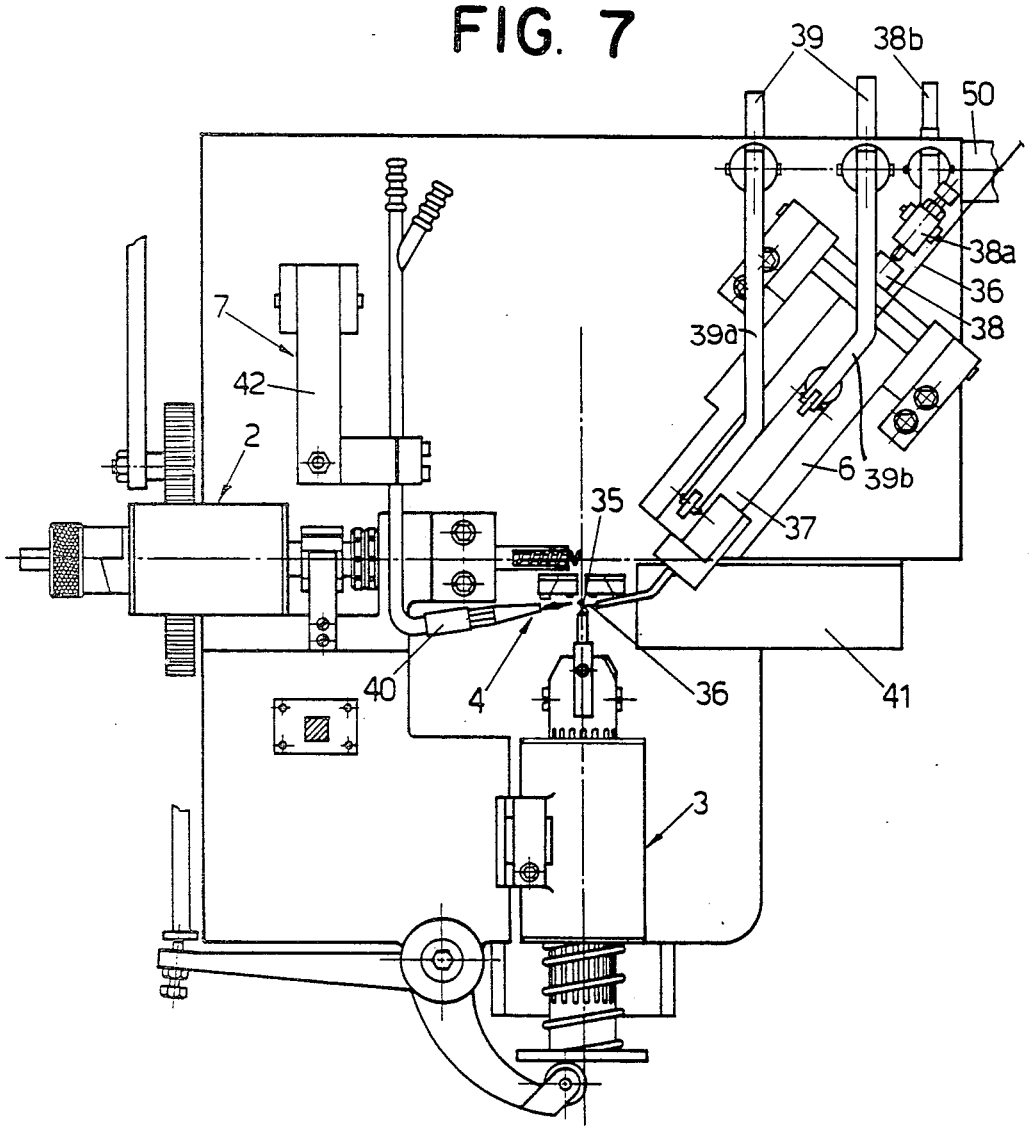
Figure 9:
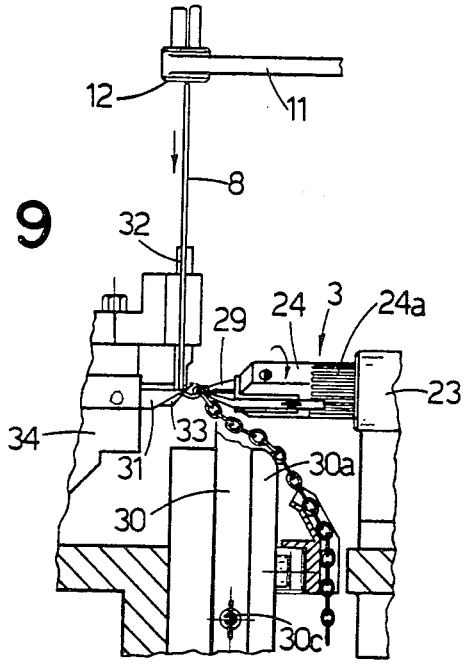
Figure 10:
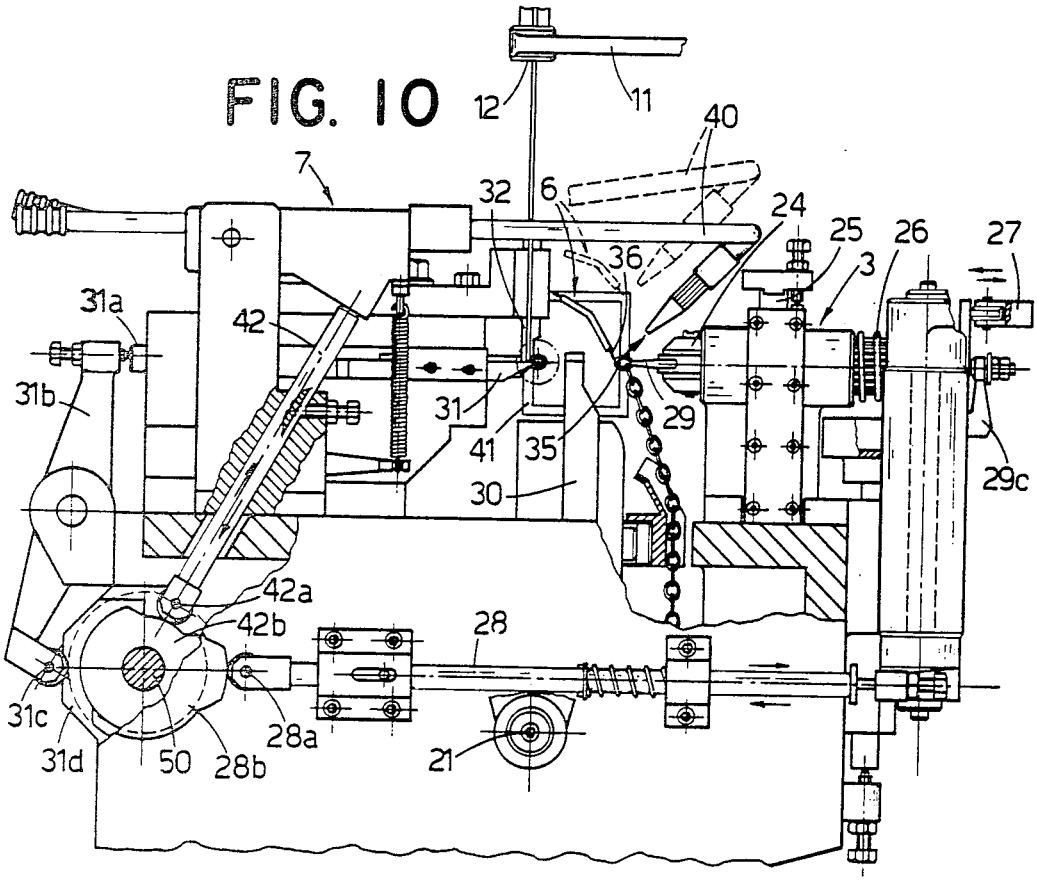

FIG. 5*b*(1) is the detail of the cutting unit of FIG. 5*b* in enlarged scale;

FIG. 5*b*(2) is a top view of the spoon-like member;

FIG. 5*b*(3) is the front view of the spoon-like member;

FIG. 5*b*(4) is the side view of the spoon-like member opposite to that shown in FIG. 5*b* and 5*b*(1);

FIG. 5*b*(5) is the cross section taken on the line 5*b*(5)—5*b*(5) of FIG. 5*b*(2);

FIG. 6 is a top view of the unit for the shaping of a wire spiral of the unit for carrying and reciprocating the pliers members and of the device for shaping the cut wire turn;

FIG. 7 is a top view of the machine in which, for clarity, the device provided to cut a wire turn has been omitted;

FIG. 6*a* is a diagrammatic side view of the cutting and shaping devices;

FIG. 6*b* and 6*c* show a detail of the shaping device in top view;

FIG. 8 shows the mutual positions of the members of the units and devices of FIG. 6 when a finished chain link is being inserted on the last spiral turn;

FIG. 9 is a side view of the parts performing the connection of a chain link to the chain;

FIG. 10 is a side view of the parts during the welding phase of a chain link;

FIG. 11 is a side view of the parts performing the welding in which other details of the welding apparatus are shown;

FIG. 12 shows the left side of the machine; and

Figure 13:
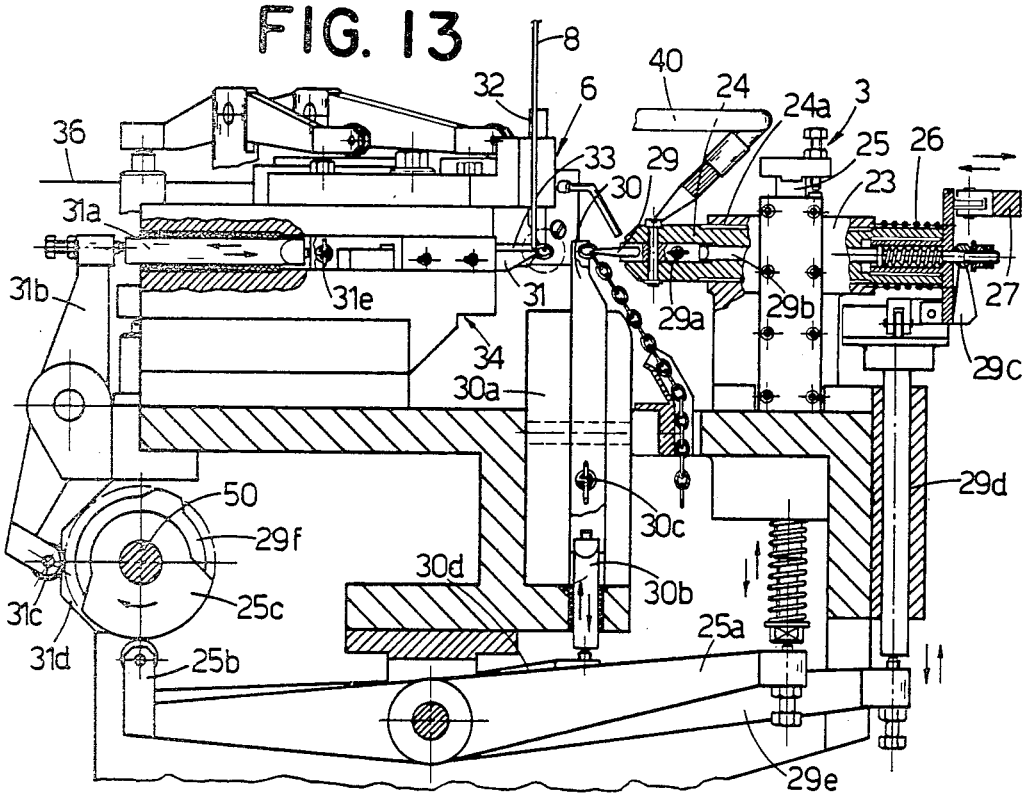

FIG. 13 shows a vertical side view, and the partial sectional view of the parts taken parallelly to the axis 13—13.

Figure 14:
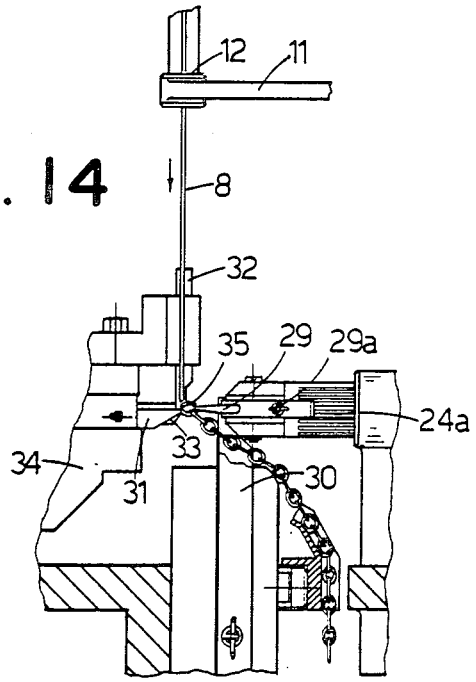

FIG. 14 is a side view of the parts after the chain link has been connected to the chain and its ends closed.

Now referring to the drawings, first of all the main devices are indicated, which compose the machine of the present invention. At 1 (FIGS. 2 and 2*a*) is generally indicated a device to feed the wire for the production of the chain links, at 2 (FIGS. 2, 2*a*, 3 to 5, 6, 7, 8) the unit to shape said wire according to a cylindrical spiral configuration, at 3 the unit carrying and reciprocating the pliers, at 4 the unit for shaping a chain link (FIGS. 1, 5, 6, 6*a*, 6*b*, 6*c* and 8), at 5 the cutting unit (FIGS. 1, 5, 5*a*, 5*b* and 5*b*(1)), at 6 the unit including a device to feed a welding wire (FIGS. 1, 7 and 11) and at 7 the unit including a welding burner (FIGS. 1, 7, 10 and 11) in this embodiment being provided to perform a welding operation with a welding material shaped as a continuous wire. Of course, the welding could be also performed according to an autogenous process. In this event, the unit 6, 7 will be suitably modified. The various devices and means will be now described in detail, bearing in mind that, for purposes of clarity, in the figures of the drawings in which the various operative phases are illustrated, all the other units of the machine which remain inoperative have been omitted. It is also to be noted that a motor is provided which, through suitable transmissions and a set of control cams or other suitable means, will enable the various devices of the machine to operate according to a predetermined time sequence and remain in operative or inoperative condition during predetermined time intervals, the driving and control apparatus can be designed by any person skilled in the art in very different ways, so as to be able to carry out the working cycle which will be hereinbelow described in detail.

Figure 1:
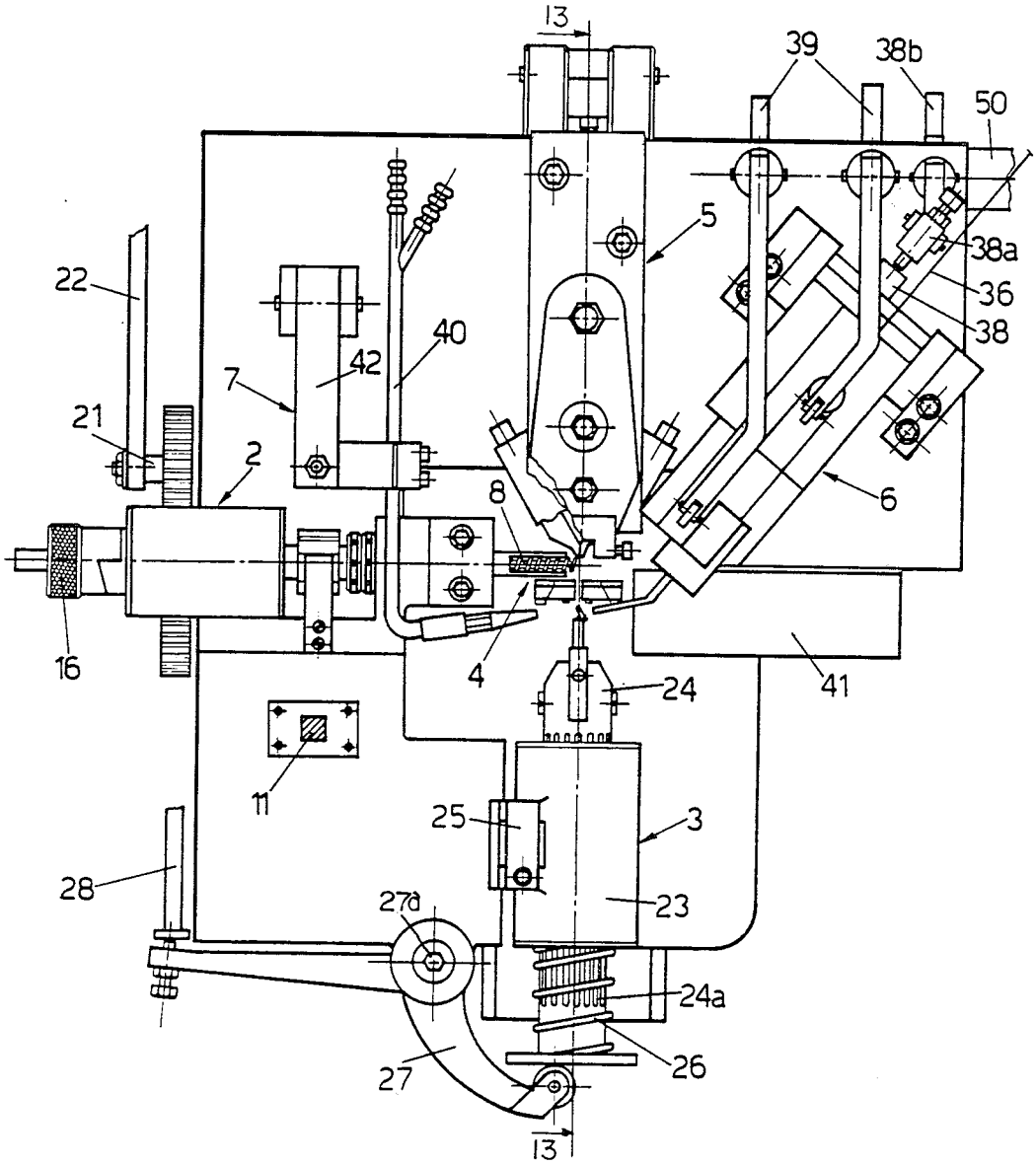
FIG. 1 is a diagrammatic top view of the machine with its operative units, with the exception of the wire feed spool, of which only its supporting post (in section) has been shown.

Now referring to FIGS. 1 to 3, wire 8 is fed from the unit 1 comprising a feed bobbin 9 carried by a support post 11, and a friction and tensioning pulley 10 for the wire 8. The trailing end of the wire 8 will be firstly wound twice around the pulley 10, then it is passed through a guiding screw-plate 12 carried by the support post 11 and it is thence inserted along a helical slot of a worm screw 13 received into a tubular housing 14 made integral with the casing of the unit 2. The screw 13 (FIGS. 2, 2*a*, 3 and 5*a*) is made integral with a shaft 15 carried by a tubular support 15*a* which extends out of the unit 2 ending with a knurled control handle 16 which is actuated manually by the operator at the beginning of the work cycle so as to let a wire portion to be wound around said female screw 13 in order to begin to form a wire spiral which according to this embodiment will be shaped as a cylindrical helix. Around the shaft 15*a* is mounted a toothed pinion 17 connected to said shaft 15*a* by means of an unidirectional clutch 18 with front engaging teeth and which a spring 19 holds in its operative condition; said pinion 17 engages a toothed sector 20 supported by the rod 21 (FIGS. 2, 2*a*, 5*a* and 12) and which is connected at 22*a* with a control connecting rod 22 pivotally connected at an eccentric point 22*b* to the wheel 22*c*, made integral with the cam shaft 50.

The operator actuates the control handle 16 up to obtain a spiral portion of wire 8, formed about the screw 13 so that its end turn 8*a* extends out of the screw housing 14 beyond the screw end. At this moment the unit 3 comprising the pliers holder (FIGS. 1, 4, 5, 6 to 8, and 13) becomes operative. This unit comprises a stationary supporting sleeve 23 into which is received a shaft 24 carrying the pliers and provided with longitudinal teeth 24*a* engaging a rack 25 (FIGS. 4, 5, and 13). When the rack 25 is in the inoperative condition, it has only the task of guiding the rod or shaft 24 during its reciprocating axial movements from its rest or starting position to its working position and vice versa. When the rack 25 becomes operative, it causes said shaft 24 to rotate axially, as will be better described hereinbelow.

The spring 26 tends to retain the rod 24 in its back positon while its forward stroke is actuated by a rocker 27 (FIGS. 1 and 12) pivoted at 27*a* and acting under the control of the bar 28 moved by a control cam 28*b* through a cam follower 28*a* (FIG. 10). The gripping members or arms 29 of the pliers are normally urged away from one another by a spring 29*a* (FIGS. 13 and 14), which arms are automatically moved into their closed position at the end of the forward stroke of the rod 24 (by wedge member 29*b* through rocking lever 29*c* and the transmission 29*d*, 29*e* actuated by cam 29*f*—FIGS. 10 and 13) after said arms 29 have been brought at both sides of the first spiral turn 8*a*, so as to tighten said turn 8*a* between them. The machine is so designed that the gripping points of the pliers 29 are positioned near the central cross section of said turn 8*a*.

In this operative phase the shaper 4 remains in its inoperative position, said shaper 4 comprising two members 30 (FIGS. 1, 4, 5, 6 6*a*, 6*c* and 13) having facing shaped surfaces, mounted on a guiding support 30*a* and associated with control wedge 30*b* and expansion spring 30*c* and adapted to allow the members 30 to slide perpendicularly to the center plane X—X of the unit 3 carrying the pliers 24 and which is controlled (FIG. 6*a*) by means of rocking lever 30*d*, cam follower 30*e*, and cam 30*f*, adapted to move the shaping members 30 to and from one another in unison. At this moment the cutting unit 5 (FIGS. 5, 5*a*, 5*b*, 5*b*(1) and 6*a*) becomes operative.

The unit 5 comprises a movable cutting blade 31 cooperating with a stationary blade 32 and with a spoonlike shaped member 33, said devices 31 and 33 being mounted on a slide 34 which serves to move them towards the wire turn 8*a*. The spoon-like member 33 (FIGS. 5*b*(1), 5*b*(2), 5*b*(3), 5*b*(4) and 5*b*(5)) has such a shape as to suit to the shape of the outer end portion of the last wire turn 8*a* and to abut against said outer portion in order to support it during the cutting phase.

A control means 31*a*, 31*b*, 31*c* (FIG. 6*a*) actuated by cam 31*d* urges the movable cutting blade 31 against the stationary blade 32 against the effect of spring 31*e* up to cut the turn 8*a* at its end and causes the ends of the wire turn 8*a* to approach each other by pressing the spoon member 33 against said turn 8*a*. After this step, the rod 24 carrying the pliers 29 still tightened around the chain link 35 is caused to move backwardly by the spring 26 (FIGS. 6, 6*a*, 6*b*, and 13), since the action of the bar 28 is released; the shaft 24 still being guided by the rack teeth 25 brings the chain link 35 between the shaping members 30 which are yet in their open position. The members 30 are caused to approach one to another, urging the ends of the chain link 35 to come into contact and imparting to said chain link 35 the desired shape (FIG. 6*c*), owing to the fact that the rack 25 becomes operative and moves in the direction of the arrow said rack movement causing the chain link 35 to be bent according to the desired form, as a result of the particular configuration which has been given to the shaping members 30. Then the shaping members 30 are moved backwards, away from the chain link 35 under the effect of spring 30*c* and the rod 24 is permitted to move back under the effect of spring 26 while the devices 29*a*, 29*b* and 29*c* maintain the pliers 29 in their closed position. The device 6 (FIGS. 1, 7, 10 and 11) provided to feed the welding wire 36, causes welding wire 36 to be fed under the control of the device 37 and the control means 39*a*, 39*b*, actuated by the cams 39. The wire 36 is advanced until its end reaches the chain link 35 in the portion of this latter in its joint zone. The welding unit 7 comprises a conventional welding burner 40, the flame of which is always lit and which is commonly positioned over the welding zone, where during this operative phase the chain link 35 is stopped.

The welding burner 40 can be moved downwards under the action of the tappet 42 so as to bring the flame in the welding position, where said flame enters into a chamber 41 (FIG. 10) lined by an incombustible material as, for instance, asbestos. Said flame heats the interposed chain link 35 while, at the same time, the feeder 37 of the wire 36 is caused to lower and to advance under the control of the cams 39 so that a short length of wire 36 is permitted to come out of said feeder 37 under the control of the transmission 38, 38*a*, actuated by cam 38*b*, said wire length end coming into contact with said chain link 35 (FIG. 7). The flame of the burner 40 now welds the chain link 35 at its joint zone, passing near the end of the wire 36 which will be melted, the welding of the joining zone being performed in this way (FIGS. 7 and 11).

At the end of this step, the rockers 38 and tappet 42 and the cams 39 return the devices of the units 6 and 7 up to their starting position while the welded chain link 35 remains held by the pliers 39 (FIGS. 7 and 9). The shaft 24 carrying the pliers 29 is then caused to move forwardly by the rocker 27 and the chain link 35 held by the pliers 29 which are guided by the rack teeth 24*a* and rack 25 is brought near the wire spiral wound about the screw 13. Then the rack 25 is caused to rotate in the opposite direction so as to bring the chain link 35 in such a position as to be capable to be inserted on the new first turn 8*a* of said wire spiral 8 (FIG. 9), when the control connecting rod 22 causes the toothed sector 20 to rotate up to let emerge the new first turn 8*a* from the support 14, said new first turn 8*a* entering into the inner space of the just finished chain link 35; thence the pliers members 29 open, under the effect of spring 29*a*. The shaft 24 carrying the now open pliers 29 is caused to rotate under the action of the rack 25 while moving backwardly while the free end of the turn 8*a* slips into the finished chain link 35. After this step, the rod 24 will be then moved forwards again by the rocker 27 so as to grip the new first spiral turn 8*a* on which the just obtained chain link 35 now remains depending. Then the entire cycle, as hereinabove described, is repeated. Of course, during the second operative cycle, the second chain link 35 has the first link, obtained in the preceding operative cycle, depending therefrom, the third chain link 35 being constructed carries the first and second chain links and so on.

What is claimed is:

1. A machine for constructing a chain of metallic shaped links comprising:

a device for feeding a wire to be used to form each chain link;

a first shaping device to wind said wire so as to form a cylindrical wire spiral of predetermined radius and pitch or of other suitable similar form;

a pliers carrying device having gripping members and supported in such a way to perform rectilinear strokes to and from the zone in which the free end of the wire spiral extends, and associated with said first shaping device, with means for axially rotating said pliers carrying device, and with means for opening and closing the gripping members of the pliers so as to grip the first free spiral turn;

a cutting device supported by means for moving said cutting device to and from the zone in which the free end of the wire spiral extends, said cutting device including cutting means for separating the first spiral turn from the said wire spiral, and shaping means for urging the ends of said cut turn to approach to one another;

a second shaping device comprising two shaping members and means for reciprocately moving said members towards and away from one another along a direction set at a right angle to the displacement and to the rotation axis of the device supporting the pliers, said members being shaped to impart the desired configuration to said wire turn when pressing said wire turn therebetween;

a welding unit to weld the ends of the chain link; and control means for moving the above described devices and means composing the machine into and retracting from said operative positions in a predetermined time sequence and at desired times.

2. The machine according to claim 1, wherein the feed device of the wire designed to form the chain links comprises a wire spool, a guiding and tensioning friction pulley for the wire and a guide means.

3. The machine according to claim 1 wherein the device to form the wire spiral comprises a worm screw which is driven, through a suitable transmission, by a manual control means, said transmission including a toothed sector and a pinion connected to the screw shaft through a unidirectional joint.

4. The machine according to claim 1, wherein the device carrying the pliers comprises a stationary support member carrying a rod supporting the pliers members, said rod having longitudinal grooves cooperating with a rack which in its inoperative condition acts only as a guiding means, during the reciprocating strokes of said rod, said strokes being controlled by a rocker acting against the force of a return spring, said pliers carrying device including means for actuating said means for opening and closing the pliers members and for actuating the rack, at and during predetermined time intervals, in a predetermined time sequence with regard of the axial movements of the pliers carrying rod.

5. The machine according to claim 1, wherein the cutting means comprises a movable cutting blade cooperating with a stationary cutting blade and means for moving the movable blade towards the stationary blade to cut the interposed first spiral turn and said shaping means comprises a spoon-like member.

6. The machine according to claim 1, wherein the second shaping device further comprises a guide way positioned at a right angle to the movement direction and to the rotation axis of the pliers carrying rod device, said shaping members riding on said guideway and acting on the turn which is held by the pliers bringing its ends into contact one with the other shaping the chain link in the desired form.

7. The machine according to claim 1, wherein the welding unit comprises a flame burner mounted on a support member, said burner being vertically movable and normally retained far from its operative position; a tunnel chamber provided with an incombustible inner lining said tunnel being locted opposite form said burner across the link welding zone and open towards the welding zone; means for lowering said burner downwards to its operative position; and a device for feeding a welding wire to the welding zone, said feeder including wire in a predetermined length thereof out from said feeder and into the link welding zone into contact with the ends of the wire turn when the feeder has reached its operative position.

8. A continuous method for constructing a chain having a plurality of shaped chain links, comprising:

(a) shaping a wire into the form of a cylindrical wire spiral of predetermined radius and pitch which is designed to ultimately form the chain links of the chain;

(b) gripping the first free wire turn of said spiral (c) cutting off the said first wire turn of said spiral; from the remaining part of said wire spiral while urging the ends of the thus-cut turn to approach each other, further urging the ends together until they touch, thereby transforming the separated wire turn into an annular piece of the desired shape and having free contacting ends;

(d) welding together the free contacting ends of the annular piece obtained in step (c) so as to form a shaped and closed chain link, passing the chain link thus formed through the free end of a new, first spiral formed according to step (a); and (e) thereafter repeating steps b–d to produce a chain having a plurality of shaped chain links.

* * * * *